United States Patent [19]

Betzler

[11] 4,026,073

[45] May 31, 1977

[54] TOOL GRINDING MACHINE

[75] Inventor: Otto Betzler, Tauberbischofsheim, Germany

[73] Assignee: Michael Weinig KG, Tauberbischofsheim, Germany

[22] Filed: Nov. 12, 1975

[21] Appl. No.: 631,381

[30] Foreign Application Priority Data

Aug. 30, 1975 Germany ..... 2538737

[52] U.S. Cl. ..... 51/100 R

[51] Int. Cl.[2] ..... B24B 3/08

[58] Field of Search ..... 51/100 R

[56] References Cited

UNITED STATES PATENTS

| | | | |
|---|---|---|---|
| 1,182,362 | 5/1916 | Fischer | 51/100 R |
| 2,419,529 | 4/1947 | Braaten | 51/100 R |
| 2,477,135 | 7/1949 | Marker et al. | 51/100 R |
| 3,106,046 | 8/1963 | Dall | 51/100 R |
| 3,875,705 | 4/1975 | Gilley | 51/100 R X |

*Primary Examiner*—Harold D. Whitehead
*Assistant Examiner*—K. J. Ramsey
*Attorney, Agent, or Firm*—Walter Becker

[57] ABSTRACT

A tool grinding machine, especially for grinding profile cutters having a frame with a plurality of grinding wheel support means thereon and with a plurality of workpiece support means slidable thereon. Each grinding wheel support means includes a first support member pivotal on a vertical axis on the frame and a second support member tiltable about a horizontal axis on the first support member and with a slide supporting the grinding wheel on the second member. Each workpiece supporting means has moveable carriages thereon to support a cutter to be ground and cooperating elements of template and follower means are provided to control relative movement between the grinding wheel and the cutters being ground.

13 Claims, 8 Drawing Figures

TOOL GRINDING MACHINE

The present invention relates to a tool grinding machine for machining the cutting edges of profiled tools, especially of cutter heads with inserted profiled cutting blades or of profiled milling cutters of solid steel or of profiled milling cutters with soldered-on profiled cutting edges or the like. The said grinding machine is provided with a machine stand with at least one headstock, the grinding spindle of which carries a grinding disc. The grinding machine is furthermore equipped with receiving means which are intended for receiving the profiled tools to be ground and which is located opposite to a grinding zone located at an area of the circulatory path of the mantle of the grinding disc. The grinding machine furthermore comprises a grinding support which is moveably mounted so as to be able to move against the mantle of the grinding disc and along the same. The grinding machine furthermore comprises a copying device which comprises a template to be arranged on a holding means of said support and also comprises a feeler or finger arranged on the machine stand for engaging the profiled template.

A grinding machine of this general type has become known in which the tool to be sharpened is chucked on a receiving means designed as grinding mandrel. This receiving means is provided for the tool on a grinding support which can be moved past the grinding disc by means of a parallelogram system. By means of this heretofore known grinding machine, clearance angles on the back of profiled tools can be ground only after a respective post adjustment of the grinding machine, especially of the supporting finger. Such post adjustments of the machine during grinding operations are time-consuming and therefore expensive and therefore additionally require very precise setting operations which can be carried out only by highly qualified operators. This last mentioned machine has furthermore the drawback that its grinding disc has repeatedly by turning operations to be profiled anew and to be exchanged when the cutting edges of profiled tools are to be ground with high precision. This additionally increases the required labor and also complicates the operating and servicing of the machine. The above mentioned heretofore known machine is, therefore, employed primarily for post grinding of tools used for machining metals, which tools, in contrast to profiled tools for machining wood and synthetic materials for for instance profiled milling cutters for window frames or milling cutter profiles for the furniture industry and relatively simple profiles.

It is, therefore, an object of the present invention so to design a tool grinding machine of the above mentioned general type that it will be able to grind complicated profiles of profiled tools in a simple manner while the necessary clearance angle on the back of the profiled tools to be ground has to be set only once and then during the grinding operation can be precisely maintained without post setting the machine.

It is a further object of the present invention to provide a tool grinding machine as set forth in the preceding paragraph which is additionally so designed that during the grinding operation, the grinding disc does not have to be profiled anew by turning, for different profiled sections.

These objects and other objects and advantages of the invention will appear more clearly from the following specification in connection with the accompanying drawings, in which:

FIG. 2 also shows diagrammatically indicated grinding discs.

Figure 2A:
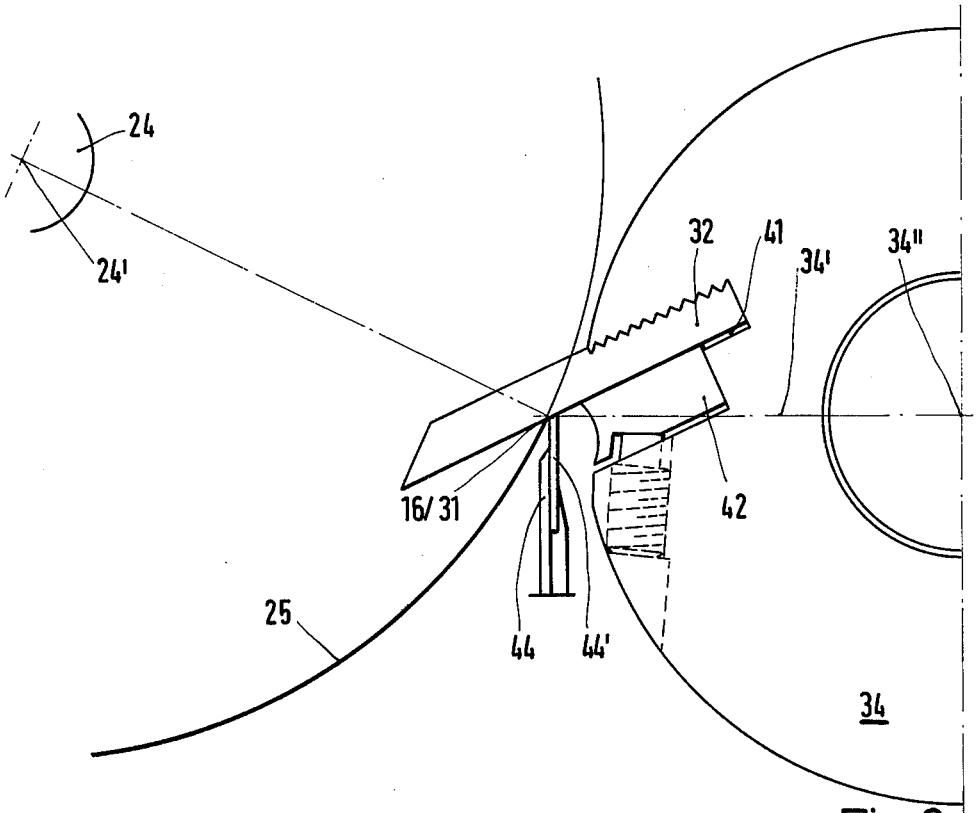
FIG. 2 is a top view of a profiled tool to be ground which has the shape of a profiled cutter plate.

FIG. 2*a* is a partial illustration (on a considerable larger scale than FIG. 2) with a portion of the grinding disc and a portion of the clamping body as well as with the profiled tool to be ground with the pivotal point of the grinding disc and with a supporting finger.

Figure 1:
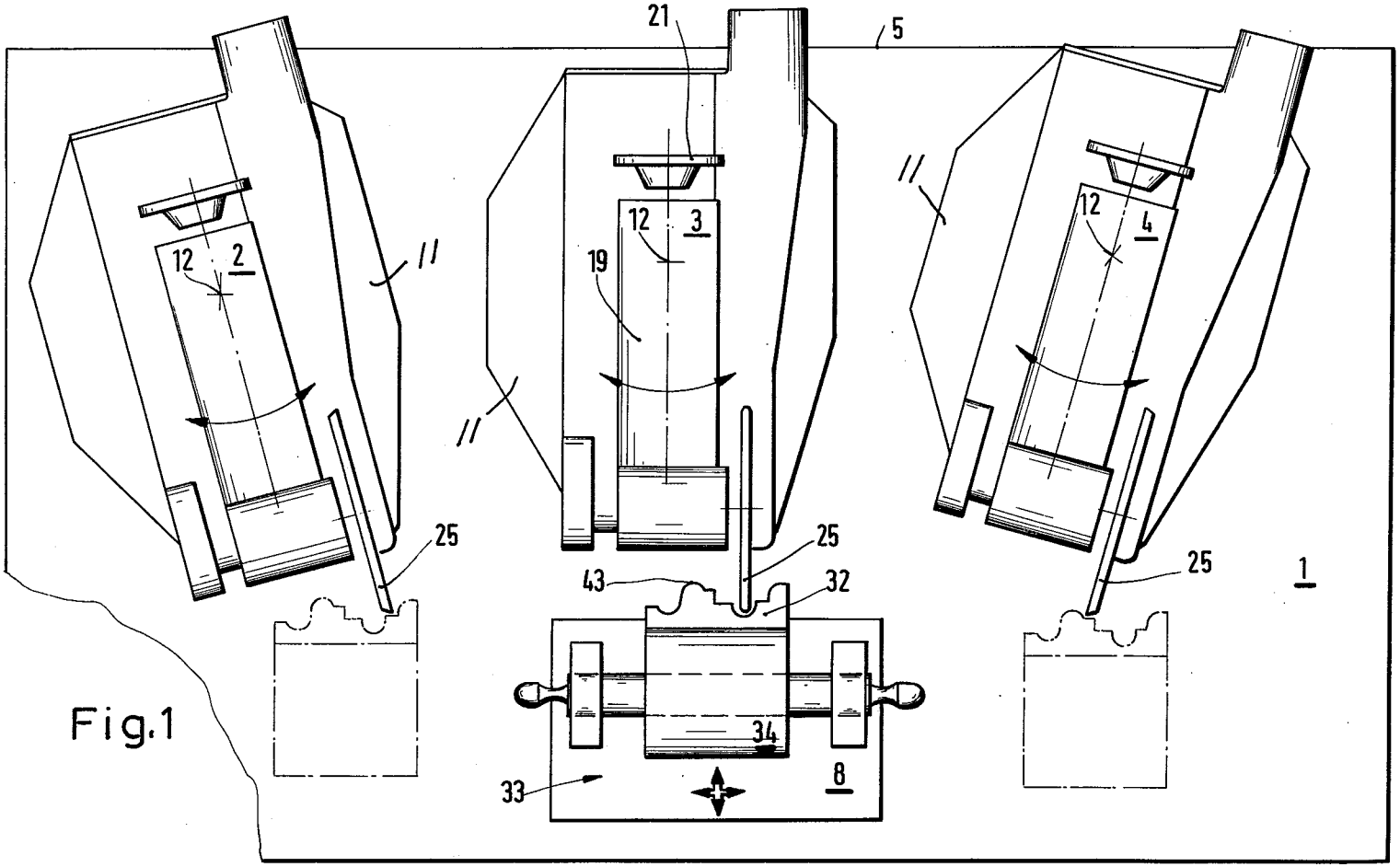
FIG. 1 represents a top view of a tool grinding machine according to the invention.
Figure 3:
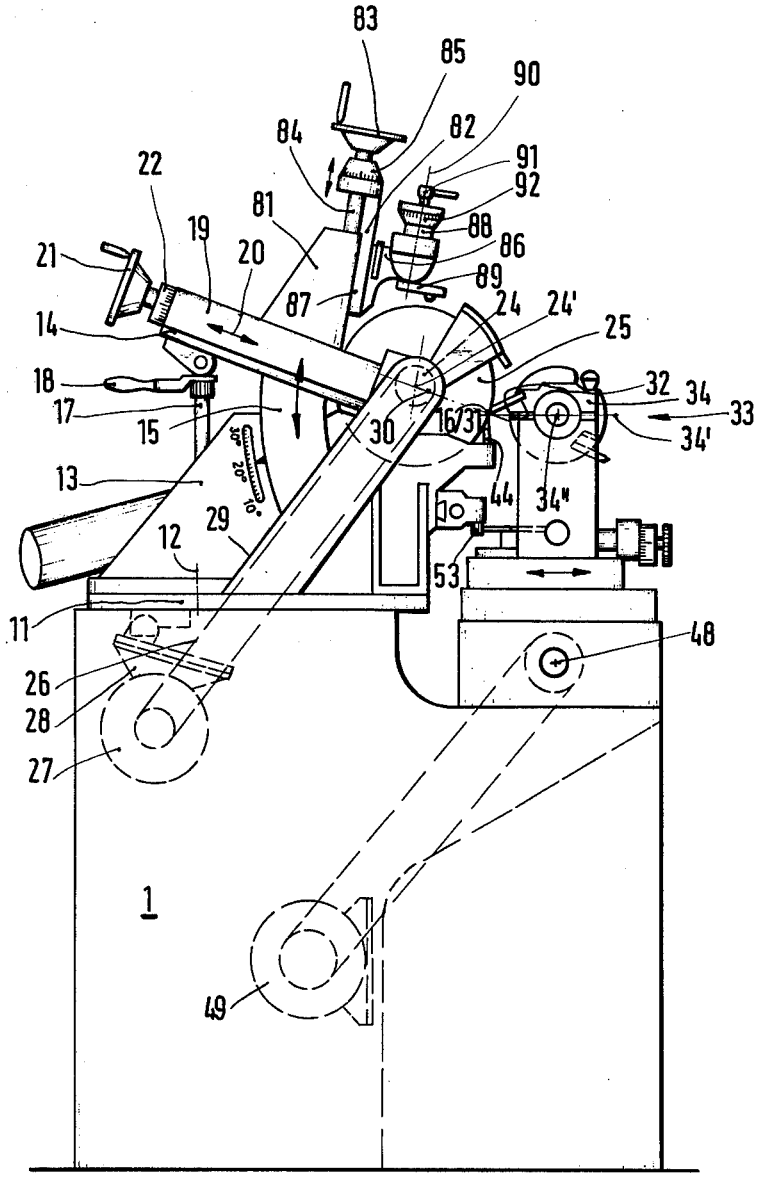

FIG. 3 is a side view of the machine shown in FIG. 1.

Figure 4:
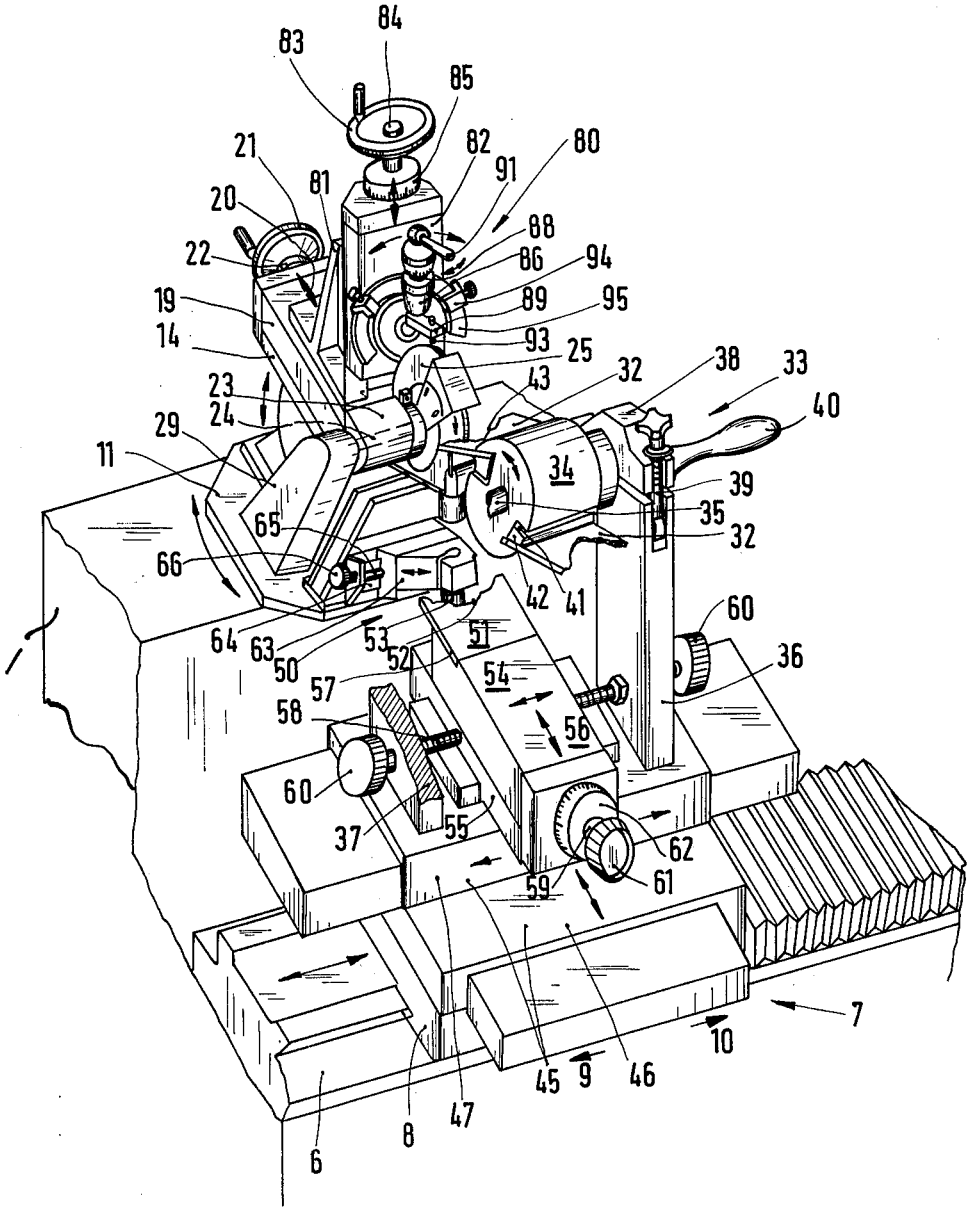

FIG. 4 is an isometric view of a cut-out of the machine according to FIG. 1.

Figure 5:
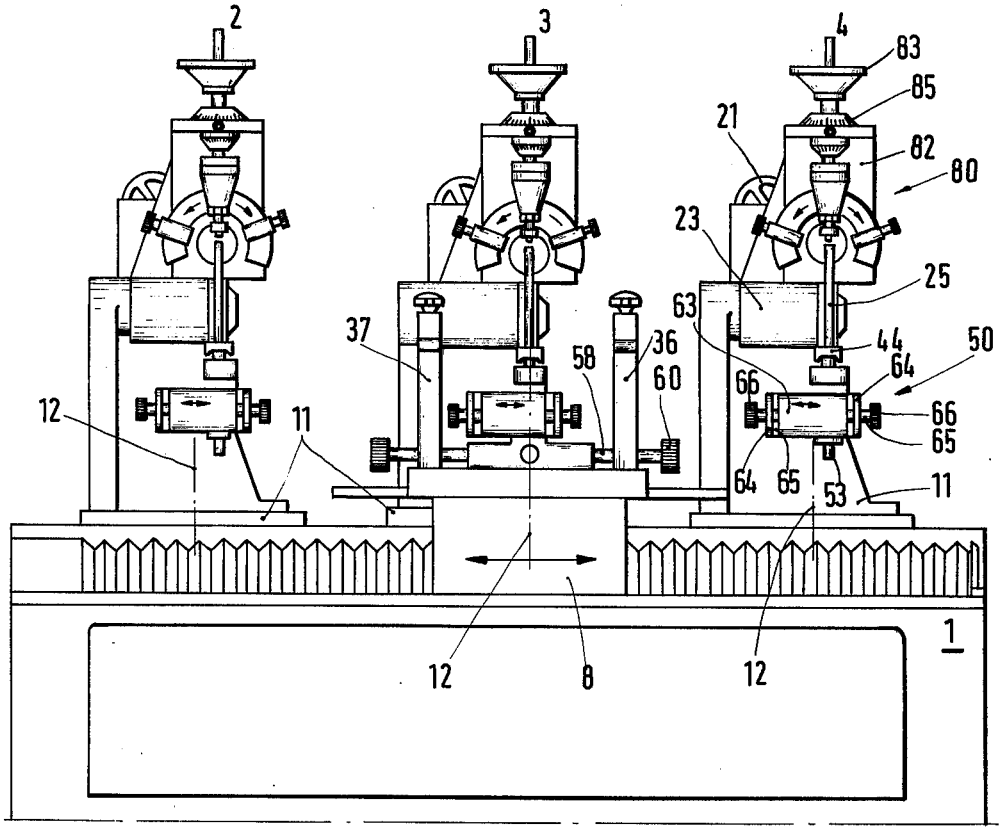

FIG. 5 shows a front view of the machine according to the invention.

Figure 6:
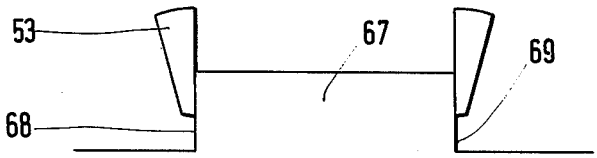
Figure 7:
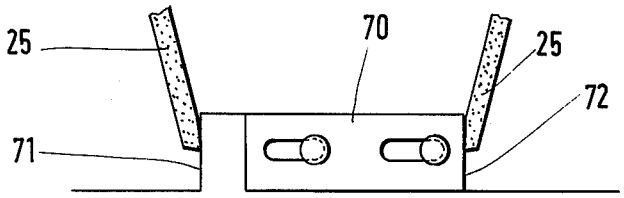

FIGS. 6 and 7 represent diagrammatic illustrations for explaining the setting of the machine.

The tool grinding machine according to the present invention is characterized primarily in that the headstock is arranged on a pivotal support which is arranged about the pivot axis located approximately parallel to the grinding spindle and passing nearly through the grinding zone of the grinding disc while being adjustably mounted on a rotatable support which latter is adjustably mounted on the machine stand for turning about an axis of rotation which extends transverse to the common axial plane of the grinding spindle and the pivot axis. The tool grinding machine according to the invention is furthermore characterized in that the grinding support has a cross slide with two support carriages one of which carries the receiving means for the profiled tool to be ground. The grinding machine according to the invention is also characterized in that the feeler finger and the holding means for the template are adjustable relative to each other for the cutting plates while said receiving means is stationarily arranged.

By turning the headstock about its axis of rotation, the grinding disc can in a simple manner be adjusted for the lateral clearing angle of the cutting edge profile to be ground. By turning the headstock about the pivot axis, the clearance angle of the back surface of the cutting edge of the cutting plate can be varied. Inasmuch as the pivot axis passes through the grinding zone, it will be appreciated that when pivoting the headstock, the position of the grinding zone does not change. The profiled tool can, however, be arranged at an angle inclined to the template, which angle corresponds to the cutting angle of the profile tool when machining a tool to be profiled so that the profile of the tool to be ground will by itself obtain those distortions relative to the profile of the template which in view of the cutting angle of the profiled tool to be ground, for instance a cutting blade plate are necessary when profiling a workpiece in order to make sure that the workpiece will get the same profile as the template. The profile of the template therefore may equal that profile at the scale 1:1 which is to be produced by means of the profiled tool, for instance a cutting blade plate. The guiding of the profiled tool to be ground along the grinding disc is due to the cross slide extremely precise.

Furthermore, the feelers and the template can be adjusted relative to each other in such a way that the engagement of the profile of the template by the feeler corresponds precisely to the engagement of the profile of the tool to be ground by the grinding disc. To this end, the feeler may be adjustable relative to the machine stand and/or the holding means for the template with regard to the grinding support along one or two coordinates while the support slide of the cross side is moveable along the same coordinates.

Referring now to the drawings in detail, the tool grinding machine illustrated in FIGS. 1 and 3–5 comprises a machine stand 1 having a stepped upper side. Arranged on said stepped upper side are three substantially identical grinding units 2–4 arranged adjacent to each other. The grinding units 2–4 are located at a higher section of the stepped upper side of the machine stand 1 near the backside 5 thereof. That section of the stepped upper side of the machine stand 1 which is located at a lower level, comprises according to FIG. 4 a horizontal slide guiding means 6 which may for instance be of a dovetail shape and on which a base carriage 8 of a grinding support 7 is displaceably mounted. The base carriage or slide 8 extends over the carriage or slide guiding means 6 at the upper side thereof. In view of the described design, the grinding support 7 is displaceable relative to the machine frame 1 in two opposite directions 9, 10 into the range of each of the grinding units 2,3,4, (FIG. 1) so that it is possible selectively to work on each grinding unit. The grinding units 2–4 are located adjacent to each other in the direction 9, 10.

Each grinding unit 2,3,4, has a rotatable support 11 (FIGS. 3–5) which is located at the upper side of the machine frame 1 and is arrestable about a vertical axis of rotation 12 relative to the machine frame 1. At the topside, the support 11 has concave circular segment shaped guiding means 13 (FIG. 3) on which there is adjustably mounted a pivotal support 14 with a segmental base 15, said pivotal support 14 being adjustable about a horizontal pivot axis 16 in conformity with a dial. For purposes of adjusting the pivotal support 14 there is provided a nearly vertical adjusting spindle 17 which is in spaced relationship to the pivot axis 16 located on the backside of the segmental base 15 and the upper end of which is linked to the lower side of the pivotal support 14 located above the rotary support 11, the lower end of the adjusting spindle 17 being linked to the rotary support 11. The adjusting spindle 17 is rotatable by means of a handle 18 located at the backside of the machine and engages a spindle nut which, for instance, is linked to the rotary support 11. At the upper side, the pivotal support 14 is provided with a carriage or slide guiding means on which a slide or carriage 19 is displaceable radially with regard to the pivot axis 16 and transverse to the rotary axis 12 in opposite directions (FIG. 20). The carriage or slide 19 is adjustable by means of a hand wheel 21 and by means of a threaded spindle in conformity with dial 22. Thus, the pivotable carriers 14 and carriages 19 together form a support 14, 19. To the front end of the carriage 19 which front end is adjacent the front side of the segmental piece 15, there is connected a spindle headstock 23 in which is rotatably journalled a horizontal grinding spindle 24. The central axis 24′ of said headstock 24 extends parallelly with regard to the pivot axis 16 and is located between said pivot axis 16 and the segmental member 15 (FIGS. 2*a* and 3). Arranged on the grinding spindle 24 is a, preferably flat, grinding disc 25 which through the intervention of an endless belt 26 is driven by a motor 27 which is arranged in the machine stand 1 below the rotatable support 11. Motor 27 is pivotable about a horizontal axis and is suspended on a bearing 28 of the machine frame 1. The axis of said bearing 28 is located in horizontally spaced relationship to the center of gravity of motor 27 so that the belt 26 is always held under tension by the weight of the motor 27. Belt 26 is located on the upper side of the machine frame 1 and extends through the rotatable carrier 11 while being arranged in a protective box 29 (FIG. 4). The belt 26 is passed over a pulley or the like arranged on the grinding spindle 24, said pulley being located on that side of the headstock 23 which faces away from the grinding disc 25. The central axis 24′(-FIGS. 2*a* and 3) of the grinding spindle 24, and the pivot axis 16 are located in a common plane 30 which extends parallelly with regard to the adjusting direction (arrow 20) of carriage 19. The adjustment of carriage 19 is at a right angle (FIG. 3) to the grinding spindle 24 and to the pivot axis 16. By adjusting the carriage 19, it is possible so to adjust the grinding disc 25 that one spot of the circulatory path of its mantle coincides with the pivot axis 16 (FIGS. 3, 2*a* ). This spot or area forms the grinding zone 31 in which the grinding disc 25 engages the tool 32 to be ground. The grinding zone 31 is located on that side of the grinding spindle 24 which faces away from the rotary carrier 11 and from the carriage 19 and is arranged at a lower level than the central axis of the grinding spindle 24 (FIG. 3). The headstock 23 is pivotal about the pivot axis 16 about an arc angle of about 20° while the axial plane 30 in each pivoted position is located at an acute angle with regard to the horizontal plane of the pivot axis 16 which last mentioned angle opens toward the backside of the rotatable support 11. By turning the support 11 about the pivot axis 12, the grinding unit can be so adjusted into a central position that the grinding spindle 24 and the pivot axis 16 are parallel to the carriage guiding means 6 of the grinding support 7. From this central position, the grinding unit can be turned about pivot axis 12 in both directions of rotation.

The grinding support 7 is provided with receiving means 33 for the profiled tools to be ground which in the illustrated embodiments form cutter plates 32. The receiving means 33 (FIGS. 3,4) comprises a substantially cylindrical support 34 for the profiled tools 32 to be ground which support 34 generally is a cutter head and henceforth will generally be called chucking body 34. The central axis 34″ of this chucking body 34 extends parallelly and horizontally with regard to the carriage guiding means 6. The axial plane 34′ (FIG. 3) of the chucking body 34 which is located at a right angle or horizontally with regard to the axis of rotation 12, intersects the plane 30, about along the pivot axis 16 when the grinding unit is aligned so as to occupy its central position. This means that the axial plane 34′ of the chucking body 34 passes through the grinding zone 31 of the grinding disc 25 so that the upper end of the supporting finger 44 and the pivot axis 16 are located in this axial plane 34′. The tool carrier or chucking body 34 is centrally located on an axle 35 which is rotatably journalled on two supporting columns 36,37 (FIGS. 4 and 5) so that the tool 32 to be ground can slide off over the supporting finger 44.

The supporting columns 36,37 have their upper ends provided with radially moveable bearing cups 38 which by means of approximately vertical clamping spindles 39 can be clamped against the ends of the axle 35 in such a way that the tool carrier or chucking body 34 will be rotatably connected. The axle 35 is journalled in play-free ball bearings. On the outside of the supporting column 36, the axle 35 is equipped with a handle 40 by means of which the upper bearing cup 38 can be lifted off whereupon the tool carrier 34 with axle 35 can be taken out after the grinding operation has been completed.

The clamping body 34 is provided with at least two groove-shaped recesses 41 (FIG. 4) which are diametrically located on the circumference of the chucking body 34 and extend over the length of said chucking body 34. A tool 32 to be sharpened is inserted into said groove-shaped recesses 31 and can be fastened therein by means of a chucking wedge 42.

When the tool 32 is in grinding position it is by the chucking body 34 directed downwardly at an angle with regard to its cutting edge 43 in such a way that the cutting edge 43 is located approximately in the horizontal axial plane of the chucking body 34. In each grinding position, that cutting edge 43 (see FIG. 4) and pivot axis 16 cover each other which coincide in each grinding position.

The plate-shaped supporting finger 44 is connected to the rotatable carrier 11 (FIG. 3) while the vertical axis of said finger 44 extends at a right angle with regard to the plane of rotation of the support 11. The tool 32 to be ground when occupying its grinding position is within the region of its cutting edge 43 supported at its bottom side against the grinding pressure.

The finger 44 is expediently so arranged that that edge thereof which engages the tool 32 scrapes off the burr which is formed on the cutting edge 43 by the grinding operation. To this end, the supporting finger 44 has a finest machined surface for instance of hard metal which forms an obtuse angled cutting edge.

The receiving means 33 is arranged on a carriage 47 of a cross slide 45 the other carriage 46 of which is displaceably arranged on the base carriage 8. The carriages of the cross slide 45 are journalled in very precise hardened roller guiding means in an absolutely play-free manner and without slipping effect. The carriage 46 is moveable horizontally and at a right angle to carriage guiding means 6, whereas the carriage 47 is moveable parallelly with regard to the carriage guiding means 6. The two carriages 46 and 47 are in this way displaceable parallelly with regard to the plane of rotation of the rotary support 11 and can manually be moved directly in their paths of movement. The supporting columns 36, 37 are in upright position connected to the upper side of the carriage 47. The base carriage 8 can be adjusted by means of an adjusting spindle 48 (FIG. 3). The spindle 48 is arranged in the machine bed below the base carriage 8 and by means of a motor 49 arranged in the machine stand 1 is driven through the intervention of a belt or the like. In this way it is possible to move the base carriage 8 repeatedly into precise predetermined working positions with regard to the grinding units 2-4.

The machine furthermore comprises a copying device 50 (FIG. 4) by means of which the movements of the receiving means 33 are controlled relative to the grinding disc 25 of each grinding unit and relative to the base carriage 8 in conformity with a template 51. The profiled template edge 52 of the template 51 equals the negative form of the profile which is to be made by tool 32. The template edge 52 is scanned or felt by a feeler finger 53. The plate-shaped template 51 is located at a lower level than the tool 32 located in sharpening position, in other words, the template 51 is located at a lower level than the grinding zone 31. The template 51 is exchangeably connected to a holder 57 which is provided on a carriage 56 of a cross slide 53. The cross slide 54 is arranged between the supporting columns 36,37 on the upper side of the carriage 47. A carriage 55 of the cross slide 54 is by means of a threaded spindle 58 displaceable on the carriage 47 parallelly to the displacing direction of the latter. On this carriage 55, the other carriage 56 is by means of a threaded spindle 59 displaceably mounted for adjustment parallel to the carriage 46, in other words at a right angle to the carriage guiding means 6. The carriages of the cross slide 54 of the copying device 50 are thus displaceable along the same coordinates as the grinding carriages 46,47 of the cross slide 45. The threaded spindle 58 has at those sides of the supporting columns 36, 37 which face away from each other rotatable knobs 60. The adjusting spindle 59 has that end thereof which is located at the front side of the machine likewise provided a rotatable knob 61 by means of which the threaded spindle 59 can be turned toward dial ring 62. The holding means 57 for the template 51 is provided on that end of the carriage 56 which faces toward the backside of the machine and on the topside of said carriage 56. The holding means 57 are so designed that the central plane of the template 51 is located parallel to the plane of rotation of the rotatable support 11. The finger 53 (FIG. 5) is exchangeably connected to a carriage 63 which by means of two adjusting spindles 65 is adjustably mounted on a carriage 64 parallel to the central axis of the grinding disc 25. That end of the adjusting spindle 65 which faces away from the grinding disc 25 is provided with a rotatable knob 66. The carriage guiding means 64 is on the front side of the rotary support 11 connected on that side of the grinding disc 25 on which the headstock 23 is located. The central axis of the finger 53 which is located below the finger 44 (FIGS. 4 and 5) is parallel to the axis of rotation 12. By means of the carriage 63, the finger 53 can be so set that its connecting surface coincides with the grinding plane 34'. The outer contour of the feeler or finger 52 has the same profile or the same cross section as the profiled grinding disc 25. Such an arrangement will assure that during the grinding operation the precise grinding profile will be copied, and that the back of the grinding disc cannot grind off the profiled contour in an undesired manner.

The grinding disc 25 of each grinding unit is in its central position or in the selected turned position of the support 11 by adjusting the carriage 19 so set that the grinding zone 31 will be located in the pivot axis 16. To this end, the grinding disc 25 is so set that its mantle is spaced from the finger 44 by about 0.5 mm.

The finger 53 of a grinding unit for instance the left hand grinding unit 2, which has been turned out of its central position about the axis 12 is so set that its contact surface coincides with the central plane of the pertaining grinding disc 25. In the holding means 57, instead of the template 51, a measuring template 67 (FIG. 6) is connected. The lateral surfaces 68,69 of said template 67 extend at a right angle to the direction of displacement to the carriage 55 and are spaced from each other by a distance which corresponds to the width of the cutting edge 43 of tool 32 to be machined. Grinding gauge 70 (FIG. 7) is connected to the receiving means 33, for instance on the chucking body 34. The lateral surfaces 71,72 of the gauge 70 extend parallelly to the displacement direction of the carriage 46 and are spaced from each other by a distance which is only slightly greater than the distance between the lateral surfaces 68,69 of the measuring template 67. The two lateral surfaces 71,72 of the grinding gauge 70 are formed by separate gauge parts which can be adjusted relative to each other in a direction transverse to the lateral surfaces 71, 72 so that the gauge 70 can be post adjusted. The measuring gauge 67 is now by adjusting the carriage 47 so displaced relative to the finger 53 of the above mentioned grinding unit 2 that the finger 53 rests against the pertaining lateral surface 68 as will be seen from FIG. 6. Subsequently, the carriage 55 is by means of the threaded spindle 58 adjusted until the pertaining grinding disc 25 comes into engagement with the corresponding lateral surface 71 of the grinding gauge 70 and until by moving the carriage 46 back and forth, a clean grinding picture appearance is obtained at said lateral surface 71. Subsequently, the grinding carriage 7 is by displacing the base carriage 8 moved relative to the machine stand 1 into a working position of another grinding unit. This grinding unit 4 is turned in a direction opposite to the first mentioned grinding unit 2 about the pertaining axis of rotation 12 relative to the central position. In the illustrated embodiment of FIG. 5, the two outer grinding units 2,4 are set in turned position relative to said central position. The carriage 63 with finger 53 is now by the grinding unit 4 adjusted until the grinding disc 25 engages the grinding gauge 70 (FIG. 7) and more specifically engages the lateral edge 72 of disc 25. Thereupon the finger 53 of this grinding unit 4 is adjusted by displacing the carriage 63, and the corresponding lateral surface 72 of the grinding gauge 70 equals the width of the measuring template 67. The third grinding unit (in the illustrated embodiment, the intermediate grinding unit 3) is so adjusted that the finger 53 and the outer profile of the grinding disc 25, both of which have the same profile, precisely cover each other in vertical projection. After the basic adjustment, the template 51 of the profiled tool 32 to be ground is inserted into the holding means 57, and a tool 32 to be ground is moved into sharpening position. Furthermore, the base carriage 8 is by successive steps brought into working position relative to each grinding unit while with each grinding unit, the pertaining sections of the cutting edge 43 of the tool 32 are machined.

Figure 2:
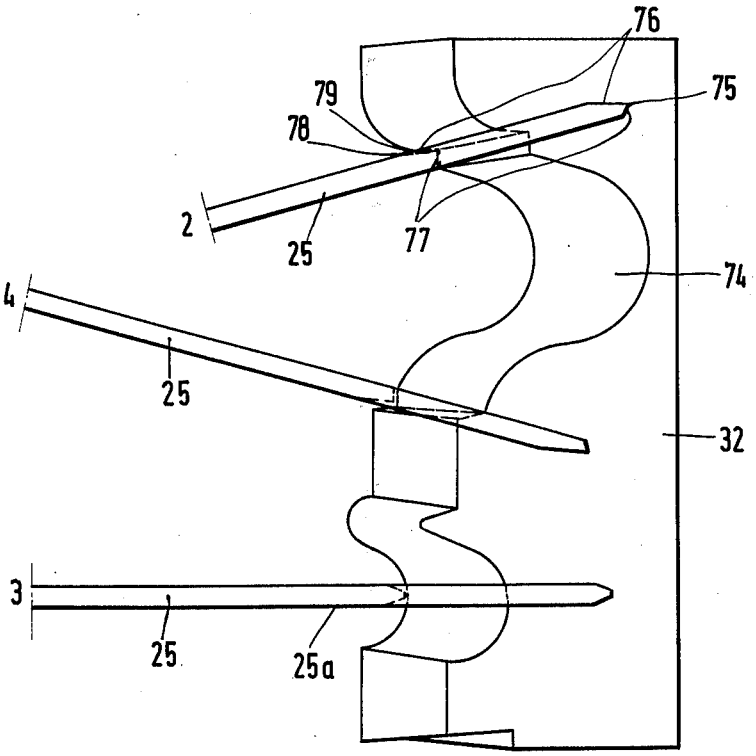

FIG. 2 diagrammatically shows the individual grinding positions of the grinding units 2,3,4, which by displacing the carriage 7 with the tool 32 to be ground will be successively occupied by the grinding units 2,3,4.

In FIG. 2, the grinding disc 25 of the intermediate grinding unit 3 is illustrated on the left hand side, and the grinding disc 25 of the right grinding unit 4 is shown in the center of FIG. 2, whereas the grinding disc 25 of the lefthand grinding unit 2 is shown on the righthand side of FIG. 2. By means of the grinding discs 25 of the grinding units 2,4, the lateral clearance surfaces 73 of cutting edge 43 can be ground while the clearance angles are determined by the angle by which the carrier 10 of the respective pertaining grinding unit is adjusted relative to the central position. By means of the grinding disc 25 of the grinding units 2,4, the lateral clearance surfaces 73 of cutting edge 43 can be ground while the clearance angles are determined by the angle by which the carrier 10 of the respective pertaining grinding unit is adjusted relative to the central position. By means of the grinding disc 25 of the grinding unit 3, the concave, convex, rectilinear and similarly shaped sections of the cutting edge 43 can be ground. The grinding disc 25 also machines the back surface 24 (FIG. 2) of cutting edge 43, while the clearance angle of said back surface is determined by the adjustment of the pivotal carrier 14.

As will furthermore be seen from FIG. 2, the grinding disc 25 of the grinding unit 2 is within the region of its circumference profiled in such a way that a grinding surface 75 is created which is formed by an end face 76 and by the mantle of the grinding disc 25. These two surfaces, in cross section of the grinding disc, form an acute angle with each other. The confining surface 76 which is formed by a truncated cone-shaped section of an end face of the grinding disc 25 confines in cross section with the central plane of said grinding disc 25 an acute angle and is located at that end face of the grinding disc 25 which when machining the pertaining clearance surface 73 is located opposite the latter. The confining surface 76, when considered in cross section according to FIG. 2, forms an angle 78 with a straight line 79 which angle opens toward the central axis of the pertaining grinding disc 25. Said straight line 79 is parallel to the displacement direction of carriage 46 in the grinding zone 31 and extends through the grinding edge 75. The other confining surface 77 of the grinding edge 75 is formed by the truncated cone-shaped mantle of the grinding disc 25. The grinding disc 25 of the other grinding unit 4 turned out of its central position is profiled as a corresponding image. The grinding dis 25 of the grinding unit 3 occupying its central position is rounded at the mantle while the rounded section through inclined flanks 25*a* merges with the plane end faces of these grinding discs 25. For purposes of profiling the respective grinding disc 25, each grinding unit has a turning-off or facing device 80 (FIGS. 3 and 4). The turning-off devices 80 of the grinding units 2,3,4 are identical and are described below in connection with a turning-off device 80. At the upper side of the carriage 19 directly behind the grinding disc 25 there is provided a carriage 81 (FIGS. 3 and 4) which parallel to the axis of rotation of the grinding disc 25 is adjustably and arrestably mounted on the carriage 19. Mounted on the front side of the carriage 81 is a slide 82 which is adjustable at a right angle with regard to the axis of rotation of the grinding disc 25. This adjustment is effected by means of an adjusting spindle 84, which at the upper end is equipped with a hand wheel 83 and an annular dial 85. The longitudinal central plane of the guiding means for the slide 82 is located parallel to or in the central plane of the grinding disc 25. This slide guiding means is inclined slightly forwardly. At the front side of slide 82 there is provided an adjusting body 86 which is pivotable about an axis 87 which latter is located in the central plane of the grinding disc 25 approximately tangentially to the upper side of the grinding disc 25 and at a right angle to the adjusting device for slide 82. Arranged on the adjusting body 86 is a bearing body 88 on which a diamond holder 89 is pivotally mounted. The pivoting axis 90 of the holder 89 is parallel to the displacement direction of the slide 82. The diamond holder 89 is located on that end face of the bearing body 88 which faces toward the grinding disc 25 and is journalled in the bearing body 88 by means of a nonillustrated spindle which above the upper end of the body 88 is provided with a lever 91 serving as handle. At the upper end of the right spindle there is furthermore arranged an annular dial 92 in conformity with which the respective position of the diamond holder 89 with regard to the pivot axis 87 can be precisely determined. The diamond holder 89 is designed in the manner of a radial arm to which a turning tool 93 comprising a diamond is connected in spaced relationship to the pivot axis 90. The diamond tip is located precisely in the extension of the radial line of the guide grinding disc, in other words it extends precisely perpendicularly with regard to the central axis of the grinding disc 25. The pivot axis 90 occupies the described position in the central position of the adjusting body 86. The adjusting body 86 can be pivoted by 180° or, expressed differently, can be pivoted from its central position in which the diamond tip occupies the precise radial location with regard to the axis of the grinding disc 25 toward each side by about 90°. The pivot movement of the adjusting body 86 is limited by two abutments 94 which are adjustable and arrestable on a ring segment 95 which is coaxial to the axis 87. The annular segment 95 is arranged at the front side of the carriage 82 and is located substantially above the axis 87 as well as behind the bearing body 88. By pivoting the adjusting body 86, the pivot plane in which the turning tool 93 is to be moved about the pivot axis 88 can in a step-free manner be moved into different inclined positions so that in addition to the mantle, also the lateral surfaces or the flanks of the grinding disc 25 can be faced and the grinding disc profiles described in connection with FIG. 2 can be produced. At the annual dial 85 there can be read by how much the diameter of the grinding disc 25 has been reduced by the facing operation. It will be understood that by the same amount the carriage 19 has to be adjusted with regard to the annular dial 22 in order to make sure that the grinding zone 31 is again located in the pivot axis 16. The adjustment of the grinding units according to the measuring template 67 must be repeated at certain time intervals if the facing tool 93 has worn. The absolute grinding precision is so high that the differences in measure between the cutting edge of different tools 32 amounts only approximately from 3/1000 to 4/1000 mm.

Principally, each grinding spindle unit 2,3,4 can individually and advantageously be employed for grinding profiled tools. Over heretofore known machines of the type involved, the advantage is obtained that due to the pivotal arrangement of the headstock 23 on the pivotal support 14 and in view of the pivotability of the grinding disc 25 in the guiding means 13 about the pivot axis 16 directly adjacent the grinding zone 31, the clearance angle at the back of the profiled tool to be ground can be set and maintained in a desired manner so that an adjustment of the supporting finger 44 with regard to the center of the grinding disc 25 is not necessary. In this way, an interruption in the grinding operation and thus a stopping as well as a post setting or new adjustment during the grinding operation will not be necessary. This advantage is based primarily on the specific arrangement according to which the center of the grinding disc 25, the pivot axis 16, and the supporting surface of finger 44 are located in a common plane 30.

The design of a grinding machine according to FIG. 5 in which three separate grinding units on a common machine part have been united to form a single grinding machine differs over the heretofore known machines of the type involved already by the fact that these three grinding units 2,3,4 while acting together are arranged on a machine frame part or foundation 1 and are adapted to be used together for grinding profiled tools. The profiled tool 32 to be ground has to be moved merely into working position of one of the three grinding units. This arrangement of the machine with the grinding units 2,3,4 thus makes it possible that all grinding operations which occur when grinding of profiled tools can be carried out on one and the same machine without the necessity that the profiled tool to be ground has to be removed or that the machine as such or parts of the machine have to be reset or replaced during the grinding operation. For all practical purposes, all occurring profiled grinding operations can be carried out on the carriages without resetting of parts of the machine, in other words, without resetting the grinding disc, the feeling finger or the supporting finger or the tool. The profiled tool to be ground has merely in its chucked condition on the carriage guiding means 6 by means of the cross slide 45 to be conveyed to the individual grinding units 2,3,4 in conformity with the respective requirement so that the respective grinding unit can grind a certain profiled section of the tool. Inasmuch as the resetting replacing and rearranging operations are no longer necessary with the machine according to the invention, also all errors and inaccuracies in the grinding operation have been eliminated. Thus, also very complicated profiled tools can be ground economically with absolute precision. This high precision is realized even when the profiled tool to be ground has to be post ground several times after it has become dull when machining wood or synthetic materials. Thus, of particular importance in connection with the manufacture of profiles for instance wood profiles or profiles in synthetic materials employed in the furniture industry or for instance in connection with profiles which are to be cut comprise bevels or miters. With profiled strips machined in this way, an absolute profiled precision is necessary because the profiled strips regardless of the profiled tool by which they have been made must for reason of economic mass production and the precision of the furniture pieces to be made always have the precise profile in order to assure that the individual bevel or miter cuts will precisely fit in each other. This requirement concerning precision in the fit of the profiled strip was heretofore not obtainable because due to the above mentioned resetting of the machine for grinding set profiled tools, inaccuracies occurred and could not be avoided, by which also the precise profiled outer contours of the wood or synthetic material profile were changed so that the furniture profiles made with such profiled tools did not have the required fitting precision. In contrast thereto, the machine according to the invention makes it possible at any desired time to post grind the profiled tools so that they will always have the precise original profile of the profiled tool. Thus, the same profile can be repeated again and again for the profiled tools to be post ground with the same precision and this also applies to the most complicated profile.

It is, of course, to be understood that the present invention is, by no means, limited to the specific showing in the drawings but also comprises any modifications within the scope of the appended claims.

What is claimed is:

1. In a tool grinding machine, especially for grinding profile cutters; a machine frame, workpiece support means mounted on said frame adapted for supporting a cutter with the edge to be ground exposed with the cutter in a predetermined plane, grinding wheel support means on the frame for rotatably supporting a grinding wheel on an axis of rotation for grinding the exposed edge of the cutter, and cooperating elements of template and follower means to control relative movement between the cutter and grinding wheel, said grinding wheel support comprising a first support member pivotal about a first axis on said frame which is transverse to the axis of rotation of the grinding wheel, a second support member mounted on said first support member for movement thereof about a second axis which is parallel to the axis of the grinding wheel and near the peripheral region of the wheel which engages the cutter, said workpiece supporting means comprising at least three superposed relatively moveable carriages the lower one of which is moveable on said frame in one direction and the others of which are moveable thereon in relative directions with the uppermost of the carriages supporting the cutter to be ground, and means supporting said template and follower for adjustment thereof relatively independantly of said workpiece support means and grinding wheel support means.

2. A tool grinding machine according to claim 1 in which said grinding wheel support means includes a grinding wheel slide on which said grinding wheel is mounted and moveable on said second support member in a direction at right angles to said axis of rotation of said grinding wheel toward and away from the cutter being ground.

3. A tool grinding machine according to claim 2 in which said means for supporting said template and follower for relative movement includes carriage means mounted on the said uppermost carriage and moveable in relative directions with the uppermost of said carriage means supporting one of said template and follower.

4. A tool grinding machine according to claim 3 which includes adjustable carriage means on said first support member and supporting the other of said template and follower.

5. A tool grinding machine according to claim 2 in which said workpiece support means includes a receiver for receiving cutters to be ground and rotatable on an axis parallel to the longitudinal direction of movement of the lowermost carriage of said workpiece support means on said frame.

6. A tool grinding machine according to claim 5 in which an axial plane through the axis of rotation of the receiver and the said second axis intersects plane of movement of the grinding wheel in the region of engagement of the grinding wheel with the cutter, and a support finger having a cutter supporting end for supporting engagement with a cutter being ground and positioned substantially at the line of intersection of said planes.

7. A tool grinding machine according to claim 2 which includes a grinding wheel dressing tool mounted on said slide and moveable relative to the axis of rotation of the grinding wheel in angularly related reciprocatory motion and in angular motion, said dressing tool including a dressing element presented substantially radially to the grinding wheel.

8. A tool grinding machine according to claim 7 which includes abutment means limiting the angular movement of said dressing tool during angular motion thereof.

9. A tool grinding machine according to claim 7 which includes a first carriage element adjustable on said slide radially of the grinding wheel, a second carriage element rotatable on the first carriage element about an axis transverse to the axis of rotation of the grinding wheel, and means on the second carriage element moveable thereon at right angles to the axis of rotation of the second carriage element and supporting said dressing tool.

10. A tool grinding machine according to claim 2 which includes a plurality of workpiece supporting means moveably mounted on said frame, a plurality of grinding wheel support means on said frame, and means for moving the workpiece support means on the frame and into operative relation with any of said grinding wheel support means.

11. A tool grinding machine according to claim 10 in which all of the workpiece support means and grinding wheel support means are substantially identical, one element of template and follower means being with each workpiece support means and the other element thereof being with each grinding wheel support means.

12. A tool grinding machine according to claim 2 which includes a support finger engaging the cutter being ground from below and having an edge adapted to remove burrs formed on the cutter by the grinding wheel.

13. A tool grinding machine according to claim 2 in which the axis of rotation of the grinding wheel and said second axis about which said second support member is pivotal are in a common plane.

* * * * *